US005580137A

United States Patent [19]

Doan et al.

[11] Patent Number: 5,580,137

[45] Date of Patent: Dec. 3, 1996

[54] TOOL BOX AND ONE-PIECE BOTTOM PANEL THEREFOR

[75] Inventors: Jimmy Doan, Kenosha, Wis.; Alois Kadlecek, Bradford; Jason C. C. Chan, Richmond Hill, both of Canada; Charles H. Heiligenthal, Kenosha, Wis.

[73] Assignee: Snap-on Technologies, Inc., Crystal Lake, Ill.

[21] Appl. No.: 407,276

[22] Filed: Mar. 20, 1995

[51] Int. Cl.[6] ..... A47B 43/00

[52] U.S. Cl. ..... 312/257.1; 312/263; 312/249.8; 52/630

[58] Field of Search ..... 312/257.1, 263, 312/249.1, 249.8, 351.7, 351.11; 52/630

[56] References Cited

U.S. PATENT DOCUMENTS

| | | | |
|---|---|---|---|
| Re. 25,364 | 4/1963 | Jacobson | 52/630 X |
| 1,913,342 | 6/1933 | Schaffert | 52/630 X |
| 2,424,217 | 7/1947 | Bales | 312/257.1 |
| 3,186,782 | 6/1965 | Ullman, Jr. | 312/263 |
| 3,408,782 | 11/1968 | Kovacs | 52/630 X |
| 3,970,209 | 7/1976 | Baxter . | |
| 4,045,104 | 8/1977 | Peterson | 312/263 X |
| 4,265,500 | 5/1981 | Berton et al. | 312/263 X |
| 4,288,132 | 9/1981 | Znamirowski et al. | 312/263 X |
| 4,340,985 | 7/1982 | Potter . | |
| 4,350,257 | 9/1982 | Groth et al. | 312/257.1 X |
| 4,643,314 | 2/1987 | Kidd . | |
| 4,895,256 | 1/1990 | Johnston . | |
| 5,117,979 | 6/1992 | Brightbill . | |
| 5,246,286 | 9/1993 | Huebshen et al. | 312/249.8 X |
| 5,249,857 | 10/1993 | Suzuki | 312/249.8 X |
| 5,294,196 | 3/1994 | Chen | 312/249.8 X |
| 5,379,887 | 1/1995 | Conley, Jr. . | |

FOREIGN PATENT DOCUMENTS

| | | | |
|---|---|---|---|
| 1153330 | 3/1958 | France | 312/257.1 |
| 1458036 | 9/1966 | France | 312/257.1 |
| 639789 | 7/1950 | United Kingdom . | |
| 786847 | 11/1957 | United Kingdom | 52/630 |
| 869609 | 5/1961 | United Kingdom | 312/257.1 |

OTHER PUBLICATIONS

Snap–on Incorporated drawing entitled "Bottom Panel Assembly for KRA3800".

Snap–on Incorporated 1994 Catalog, p. 24, illustrating KRA3800 storage unit.

*Primary Examiner*—Peter M. Cuomo
*Assistant Examiner*—Rodney B. White
*Attorney, Agent, or Firm*—Emrich & Dithmar

[57] ABSTRACT

A tool box has an upstanding side wall structure which may have a front opening to receive one or more drawers, the side wall structure being closed at the upper end by a top panel and at the lower end by a unitary, one-piece bottom panel. The bottom panel has three parallel depending ribs deformed from the plane of a base wall, with one rib disposed along a front edge of the base wall and being unitary with an upstanding front flange with a rearwardly extending lip. Side flanges, spaced apart by the ribs, depend from each side edge of the base wall. In one embodiment a rear flange depends from the rear edge of the base wall and in a second embodiment a channel-shaped upstanding rear wall is provided. The flanges and rear wall of the bottom panel provide means for attachment thereof to the side panel structure and slots are provided in the bottom panel for attachment of casters.

14 Claims, 1 Drawing Sheet

TOOL BOX AND ONE-PIECE BOTTOM PANEL THEREFOR

BACKGROUND OF THE INVENTION

1. Field of the Invention

The present invention relates to tool box or tool chest constructions and, in particular, to a bottom panel structure for such a tool box or tool chest.

2. Description of the Prior Art

Tool boxes or tool chests or cabinets of various constructions have been provided for many years, a variety of such tool boxes and tool chests being sold by Snap-on Incorporated, the assignee of the present invention. Such tool boxes and tool chests are typically formed of steel and include a plurality of parts secured together by any suitable means, such as welding. In particular, a bottom panel structure for such a tool box may include as many as seven pieces, depending upon the size of the tool box. Thus, the panel structure may include a base wall which may or may not be provided with peripheral flanges, attachment rails fixed to the underside of the base wall by welding to provide rigid attachments for casters and the like, and stiffening members fitted between the attachment rails and the base wall at least at the opposite ends of the base wall to rigidify and strengthen the structure. This construction is expensive and time consuming, because it requires the inventorying of a large number of parts and also requires a number of assembly steps.

SUMMARY OF THE INVENTION

It is a general object of the present invention to provide an improved bottom panel structure for a tool box which avoids the disadvantages of prior constructions while affording additional structural and operating advantages.

An important feature of the invention is the provision of a bottom panel structure of the type set forth, which is of simple and economical construction.

In connection with the foregoing feature, a further feature of the invention is the provision of a bottom panel structure of the type set forth which is of unitary, one-piece construction.

In connection with the foregoing features, a still further feature of the invention is the provision of a bottom panel structure of the type set forth which affords strength and rigidity without the attachment of separate rigidifying structures.

Yet another feature of the invention is the provision of a tool box incorporating a bottom panel structure of the type set forth.

These and other features of the invention are attained by providing a tool box comprising: an upstanding side panel structure having upper and lower ends; a top panel connected to the upper end of the side panel structure for closing same; and a unitary one-piece bottom panel connected to the lower end of the side panel structure for closing same; the bottom panel including a substantially rectangular flat planar base wall having a front edge and a rear edge and opposed side edges, a plurality of ribs deformed out of the plane of the base wall and each extending from one to the other of the side edges, a rear flange extending out of the plane of the base wall at the rear edge, and a plurality of side flanges extending out of the plane of the base wall at the side edges.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENTS

Figures 1, 2, 3, 4, 5, 6:
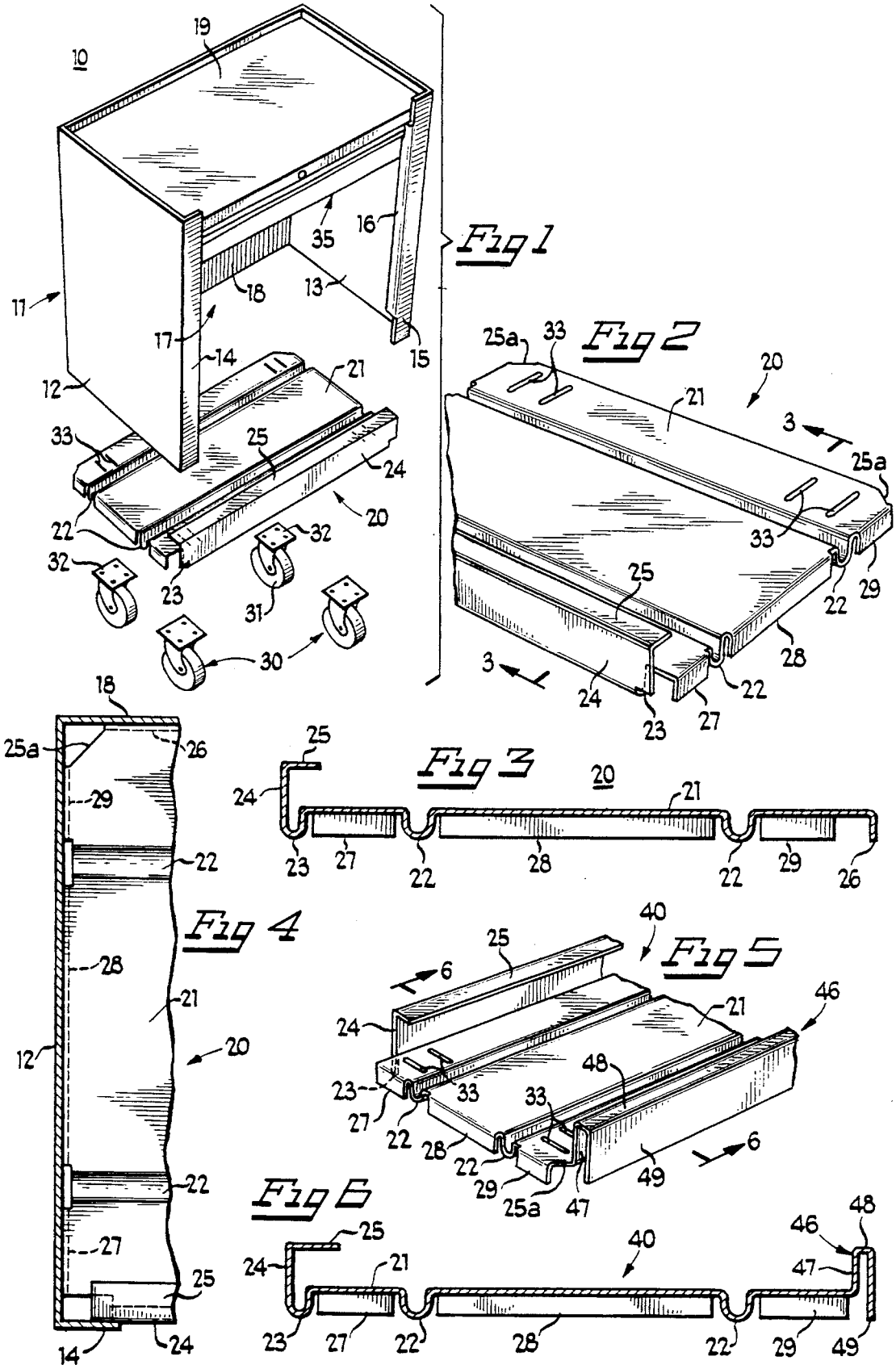
FIG. 1 is an exploded perspective view of a tool box incorporating a bottom panel constructed in accordance with and embodying the features of a first embodiment of the present invention.
FIG. 2 is an enlarged, fragmentary, perspective view of the bottom panel of the tool box of FIG. 1 as viewed from the right front corner thereof.
FIG. 3 is a further enlarged view in vertical section taken along the line 3—3 in FIG. 2.
FIG. 4 is an enlarged, fragmentary sectional view of the lower left-hand side of the tool box of FIG. 1, illustrating the attachment of the bottom panel therein.
FIG. 5 is a fragmentary rear perspective view of a bottom panel in accordance with a second embodiment of the invention.
FIG. 6 is a view, similar to FIG. 3, of the bottom panel of FIG. 5, taken along the line 6—6 in FIG. 5.

Referring to FIGS. 1 and 4, there is illustrated a tool box or chest, generally designated by the numeral 10, incorporating a bottom panel 20 in accordance with a first embodiment of the present invention. The tool box 10 includes a upstanding side panel structure 11 which includes parallel, opposed side walls 12 and 13, respectively provided at their front edges with substantially coplanar inturned front flanges 14 and 15. Unitary with the inner edge of each of the front flanges 14 and 15 and projecting rearwardly therefrom substantially parallel to the side walls 12 and 13 are inturned flanges 16 (one shown). The flanges 16 terminate longitudinally a predetermined distance short of the upper and lower edges of the flanges 14 and 15 and cooperate to define therebetween a front opening 17 into the tool box 10. The side walls 12 and 13 are joined at their rear edges by a rear wall 18. The side panel structure 11 is closed at its upper end by a top panel 19, which is secured by suitable means to the side walls 12 and 13, the front flanges 14 and 15 and the rear wall 18.

Referring now also to FIGS. 2–3, the side panel structure 11 is closed at the lower end thereof by the bottom panel 20, which is of unitary, one-piece construction. The bottom panel 20 includes a flat, planar, substantially rectangular base wall 21. Two spaced-apart ribs 22, each parallel to the front and rear edges of the base wall 21, are deformed downwardly from the plane of the base wall 21 and are, respectively, spaced a predetermined distance from the front and rear edges of the base wall 21. A front rib 23 is deformed downwardly out of the plane of the base wall 21 at the front edge thereof and has ends which are preferably spaced laterally inwardly from the side edges of the base wall 21. Each of the ribs 22 and 23 is substantially U-shaped in transverse cross section and extends laterally along the entire width of the base wall 21 from one side edge to the other side edge thereof. While arcuate U-shaped ribs are shown, it will be appreciated that each of the ribs 21–23 could be angular in cross-section, the shape depending on the fabrication process used. The front rib 23 has a smaller radius than the other ribs and its forward end is continuous along its entire length with an upstanding, flat, rectangular front flange 24, which projects a predetermined distance upwardly above the plane of the base wall 21 and is unitary at its upper edge with a rearwardly extending lip 25, which is spaced a predetermined distance above the base wall 21 substantially parallel thereto. The rear corners of the base wall 21 are bevelled, as at 25*a*, and a rectangular rear flange 26 depends from the rear edge of the base wall 21 along its entire width. Depending from each of the side edges of the base wall 21 are three side flanges 27, 28 and 29. In particular, the forwardmost side flanges 27 are disposed between the front rib 23 and the forwardmost one of the ribs 22, the middle side flanges 28 are relatively long and are disposed between the ribs 22, while the rearwardmost side flanges 29 are disposed between the rear flange 26 and the rearwardmost rib 22.

Formed through the base wall 21, respectively adjacent to the four corners thereof, are four pairs of parallel slots 33 for receiving therethrough suitable fasteners (not shown) for securing casters 30. More specifically, four casters 30 are typically provided, each including a caster wheel 31 secured by a suitable clevis bracket to an attachment plate 32, which abuts the underside of the base wall 21 for receiving the fasteners therethrough in a well-known manner. While slots 33 are shown, groups of discrete fastener holes could also be provided.

The tool box 10 may be provided with one or more drawers 35 (one shown in FIG. 1), slidably supported on associated drawer slides (not shown) carried by the side panel structure 11 in a well-known manner, for opening and closing movements through the front opening 17 of the tool box 10.

Referring in particular to FIG. 4, in assembling the bottom panel 20 with the side panel structure 11, the bottom panel is fitted up inside the lower end of the side panel structure 11, with the front flange 24 abutting the inner surfaces of the front flanges 14 and 15, with the side flanges 27–29 abutting the inner surfaces of the side walls 12 and 13 and with the rear flange 26 abutting the inner surface of the rear wall 18, these abutting parts all being fixedly secured together by suitable means, such as welding or the like. It will be appreciated that the front flange 24 is dimensioned so that it fits beneath the lower edges of the inturned flanges 16 of the side panel structure 11, and the lip 25 may provide an escutcheon for the lowermost drawer 35 in the tool box 10. There results a bottom panel construction which is very inexpensive and easy to manufacture and assemble and which, nevertheless, provides a strong, rigid construction.

Referring now also to FIGS. 5 and 6, there is illustrated an alternative embodiment of a bottom panel, generally designated by the numeral 40, which is substantially the same as the bottom panel 20, except for the rear flange thereof. Accordingly, like parts of the bottom panels 20 and 40 bear the same references numerals. The bottom panel 40 is provided with an upstanding, generally channel-shaped rear wall 46 at the rear edge of the base wall 21 along its entire length. The rear wall 46 includes an upstanding, rectangular flange 47 integral with the base wall 21 and extending thereabove substantially the same distance as the front flange lip 25. The flange 47 is unitary at its upper edge with a rearwardly extending flange 48 which is, in turn, unitary with a depending flange 49 which extends downwardly below the level of the base wall 21 to a distal edge substantially coplanar with the bottom edges of the side flanges 27–29. This configuration affords a larger abutment area with the rear wall 18 of the side panel structure 11, and results in the base wall 21 being spaced a slight distance forwardly of the rear wall 18.

While the illustrated embodiment of the tool box 10 is an open-front construction, including one or more drawers, it will be appreciated that the present invention is usable with other types of tool box constructions. More particularly, the tool box could have a closed front wall with a hinged top or cover, in a known manner.

Preferably, the bottom panels 20 and 40, as well as the side panel structure 11, are formed of a suitable steel, but it will be appreciated that other materials could be used.

From the foregoing, it can be seen that there has been provided an improved tool box and bottom panel therefor which are of simple and economical construction while affording great strength and rigidity.

We claim:

1. A tool box comprising: an upstanding side panel structure having upper and lower ends; a top panel connected to the upper end of the said side panel structure; and a unitary one-piece bottom panel connected to the lower end of the said side panel structure; said bottom panel including a substantially rectangular flat base wall defining a plane and having a front edge and a rear edge and opposed side edges, said side edges being spaced apart by a width, a plurality of ribs deformed downwardly out of the plane defined by said base wall and each extending from one to the other of the said side edges, one of said ribs being disposed at said front edge and having a front portion, a front flange unitary with said front portion of said one rib and extending upwardly above the plane defined by said base wall, a rear flange extending out of the plane defined by said base wall at said rear edge, and a plurality of side flanges extending out of the plane defined by said base wall at each of said side edges.

2. The tool box of claim 1, wherein said ribs are substantially parallel to each other.

3. The tool box of claim 2, wherein said ribs are substantially parallel to said front and rear edges.

4. The tool box of claim 1, wherein all of said flanges and said ribs extends in a single predetermined direction out of the plane defined by said base wall.

5. The tool box of claim 4, wherein each of said ribs and said flanges depends downwardly from said base wall.

6. The tool box of claim 1, wherein said rear edge has a length, said rear flange extending along substantially the length of said rear edge.

7. The tool box of claim 1, wherein said side panel structure has a front opening therein, and further comprising at least one drawer slidably mounted on said side panel structure for opening and closing movements through said front opening.

8. A unitary one-piece bottom panel for a tool box comprising: a substantially rectangular flat base wall defining a plane and having a front edge and a rear edge and opposed side edges, said side edges being spaced apart by a width, a plurality of ribs deformed downwardly out of the plane defined by said base wall and each extending from one to the other of the said side edges, one of said ribs being disposed at said front edge and having a front portion, a front flange unitary with said front portion of said one rib and extending upwardly above the plane defined by said base wall, a rear flange extending out of the plane defined by said base wall at said rear edge, and a plurality of side flanges extending out of the plane defined by said base wall at each of said side edges.

9. The bottom panel of claim 8, wherein said ribs are substantially parallel to each other.

10. The bottom panel of claim 9, wherein said ribs are substantially parallel to said front and rear edges.

11. The bottom panel of claim 8, wherein all of said flanges and said ribs extends in a predetermined direction out of the plane defined by said base wall.

12. The bottom panel of claim 11, wherein each of said ribs and said flanges depends downwardly from said base wall.

13. The bottom panel of claim 8, wherein said rear edge has a length, said rear flange extending along substantially the length of said rear edge.

14. The bottom panel of claim 8, wherein the rib at said front edge has a front-to-back width and a lateral length which are, respectively, less than the width and length of the other ribs.

* * * * *